US007065910B2

(12) United States Patent
Woodruff

(10) Patent No.: US 7,065,910 B2
(45) Date of Patent: Jun. 27, 2006

(54) ILLUMINATED DISPLAY DEVICE

(76) Inventor: Michael A. Woodruff, 5313 Shannon Park Dr., Dublin, OH (US) 43017

( * ) Notice: Subject to any disclaimer, the term of this patent is extended or adjusted under 35 U.S.C. 154(b) by 0 days.

(21) Appl. No.: 10/718,078

(22) Filed: Nov. 20, 2003

(65) Prior Publication Data

US 2006/0090384 A1 May 4, 2006

(51) Int. Cl.
*G09F 13/22* (2006.01)

(52) U.S. Cl. ..... 40/544; 40/594; 362/368; 362/397

(58) Field of Classification Search ..... 40/594, 40/544, 124.02, 593; 362/503, 368, 397
See application file for complete search history.

(56) References Cited

U.S. PATENT DOCUMENTS

| | | | | |
|---|---|---|---|---|
| 2,046,924 | A * | 7/1936 | Pendergast | 156/240 |
| 3,700,879 | A | 10/1972 | Franc | |
| 3,740,543 | A | 6/1973 | Franc | |
| 4,439,818 | A * | 3/1984 | Scheib | 362/250 |
| 4,866,580 | A | 9/1989 | Blackerby | |
| 4,900,604 | A * | 2/1990 | Martinez et al. | 428/79 |
| 5,034,658 | A | 7/1991 | Hiering et al. | |
| 5,315,492 | A | 5/1994 | Davenport | |
| 5,471,773 | A * | 12/1995 | Hoffman | 40/544 |
| 5,566,384 | A * | 10/1996 | Chien | 362/486 |
| 5,970,638 | A * | 10/1999 | Henley | 40/594 |
| 5,985,382 | A * | 11/1999 | Shuen | 428/31 |
| 6,013,346 | A * | 1/2000 | Lewis et al. | 428/78 |
| 6,015,218 | A | 1/2000 | Snell | |
| 6,143,381 | A | 11/2000 | Hawkins | |
| 6,171,681 | B1 | 1/2001 | Mascarenhas et al. | |
| 6,258,200 | B1 * | 7/2001 | Kassab | 156/273.1 |
| 6,308,445 | B1 | 10/2001 | Porraro | |
| 6,464,381 | B1 * | 10/2002 | Anderson et al. | 362/488 |
| 6,663,063 | B1 * | 12/2003 | Tatta | 248/205.3 |
| 6,727,647 | B1 * | 4/2004 | Fukuda et al. | 313/506 |
| 6,811,895 | B1 * | 11/2004 | Murasko et al. | 428/690 |
| 6,865,831 | B1 * | 3/2005 | Launey | 40/124.02 |
| 2002/0187365 | A1 * | 12/2002 | Fowlkes | 428/690 |

FOREIGN PATENT DOCUMENTS

GB 2231551 A * 11/1990

* cited by examiner

*Primary Examiner*—Joanne Silbermann
(74) *Attorney, Agent, or Firm*—Jason H. Foster; Kremblas, Foster, Phillips & Pollick

(57) ABSTRACT

A display device that can be mounted to a surface, such as a window, using static attraction. The display device has an illumination assembly circuit including a light source (such as an LED), a power supply (such as a battery) and a switch interposed therebetween. The illumination assembly is either attached to or enclosed within a mounting film, such as a flexible polymer that is electrostatically attracted to a surface. A preferred device has indicia printed on it to display, and with which the LEDs cooperate.

41 Claims, 3 Drawing Sheets

ILLUMINATED DISPLAY DEVICE

BACKGROUND OF THE INVENTION

1. Field of the Invention

This invention relates generally to a display device for decoration, advertising or education, among others, and, more specifically, to an illuminating display device with a light source and a mounting assembly for mounting the display device to a surface.

2. Description of the Related Art

Displays are used in a wide variety of applications such as promotions, advertising, decorations, and as signs to communicate information or warnings. Many retail stores employ display signs for decoration or to indicate whether the store is open or closed.

Common display signs carry a message or design imprinted thereon. A display sheet can be mounted within a frame having a light source therein. The front face of the sheet may be lighted by lights located along the periphery of the frame. Alternatively, when using a transparent or translucent sheet, back lighting may also be employed.

The prior art includes display signs that use a frame and a source of light along with a glass or other transparent sheet having an image or other information formed on the sheet; for example, by glass etching, masking, painting and the like. When it is required or desirable to change this type of display, it is necessary to create a new piece of glass. The preparation of a new glass sheet, coupled with shipping precautions due to the frailty of glass, makes such signs very expensive. Furthermore, as these signs increase in size, the practical problems of limited display space and proper display implementation become controlling due to weight and size considerations.

Recently, sign technology has progressed beyond these traditional paper boards or back-lit etched glass boxes. Those in the field have taken advantage of discoveries in material science and in the electronics areas to develop more efficient signs and displays. However, such prior art displays and signs are still lacking in desirable characteristics.

Static cling films are polymeric or other materials that adhere directly to a substrate due to electrostatic interaction between the film and the surface of the substrate. The substrates to which such films cling include glass, plastic and metal, among others. Static cling films adhere to surfaces without the use of adhesives. Therefore, such cling films can readily be removed from the surface and reapplied to the same or a different surface many times.

Cling films are usually highly flexible polymeric films that cling to a variety of surfaces. The ability of the film to stick to a surface without adhesive, coupled with the ability to receive ink:, makes the film a versatile display. Examples of current uses of static films include mounting to the fronts of appliances where advertising helps to explain the various features of the product and retail store windows to indicate a sale or other information.

An advantage of a static cling film is that the cling film can be removed from a substrate without leaving residue. One recent high-volume use of cling films (in particular, vinyl film) has been as oil change reminders. When an oil change is performed, a static cling film sticker is marked with date and mileage information and applied to the upper left-hand corner of the automobile windshield to remind the vehicle's owner when the oil in the vehicle should be changed again. The sticker can be removed easily and replaced with a new sticker.

Many of the cling films which are currently used are poly vinyl chloride (PVC) based films. These materials have found extensive utility because they are highly flexible and inexpensive. The flexibility is achieved by the inclusion of additives such as plasticizers and/or tackifiers. Various thermoplastic elastomers have also been utilized. Commercially available thermoplastic elastomers (TPE) are either block copolymers (e.g., styrenics, copolyesters, polyurethanes and polyamides) or elastomer/thermoplastic compositions such as thermoplastic elastomeric olefins (TEO) and thermoplastic vulcanizates (TPV).

It is known that consumers enjoy placing decorative devices in the windows of their homes, automobiles and places of business. For example, at Christmas people commonly place electric lamps in the shapes of candles on the windowsills of their homes. Such lamps have glass bulbs and are battery powered or have cords that, in the best of circumstances, hang down over the windowsill to an outlet below the candle. Because these lamps are unstable, they are often secured by wire or other fasteners to prevent people or pets from knocking the lamps off the sills, where they can be destroyed or the glass bulb can be shattered, thereby causing a safety hazard.

Although there are many useful displays in the prior art, there is the need for a display device that overcomes the disadvantages of the prior art.

BRIEF SUMMARY OF THE INVENTION

The invention is a display device. The display device includes an illumination assembly having an electrical circuit that includes an electrical power supply, preferably a battery, a light source and a switch electrically interposed between the light source and the power supply. In the preferred embodiment, the light source is a light-emitting diode (LED), although any light source can be used. A mounting film is attached to the illumination assembly. The mounting film is preferably a static cling film for mounting the illumination assembly and mounting film to a substrate, such as a window, with static attraction. The mounting film has a first major surface and a second, opposite major surface. The second, opposite major surface preferably has at least one indicium on it.

In a preferred embodiment, the switch is manually actuatable, and the electrical circuit including the battery, the light source and the switch is enclosed within a housing that is attached to the mounting film. Such a display device is relatively simple, attaches and stays attached to a window, mirror, appliance front or any other suitable substrate and illuminates any indicia on the mounting film.

The present invention not only imparts the characteristics lacking in the prior art but also contains many other attributes required for an ideal display device. To successfully deliver the message, the device is effective, efficient, durable, practical, easy and safe to use, as well as reliable and affordable. The preferred embodiment of the invention has a very small thickness because it is made using an LED, a button-like battery, and a thin switch. These are attached to a very thin static cling film, providing a display device that does not protrude into a room, nor does it rest upon a window sill or hang from a window frame. This causes the invention to be extremely safe inasmuch as it is virtually impossible to unintentionally remove from the substrate, such as a window.

The invention is lightweight, simple in design with minimal components, and is easily and quickly attached to and removed from the substrate without damaging the surface to which it is attached. In addition, the design allows for quick and easy changes of the displayed indicium or indicia. The invention represents significant improvements and advantages over, and exceeds the capabilities of, all prior related inventions of record.

Figure 1:
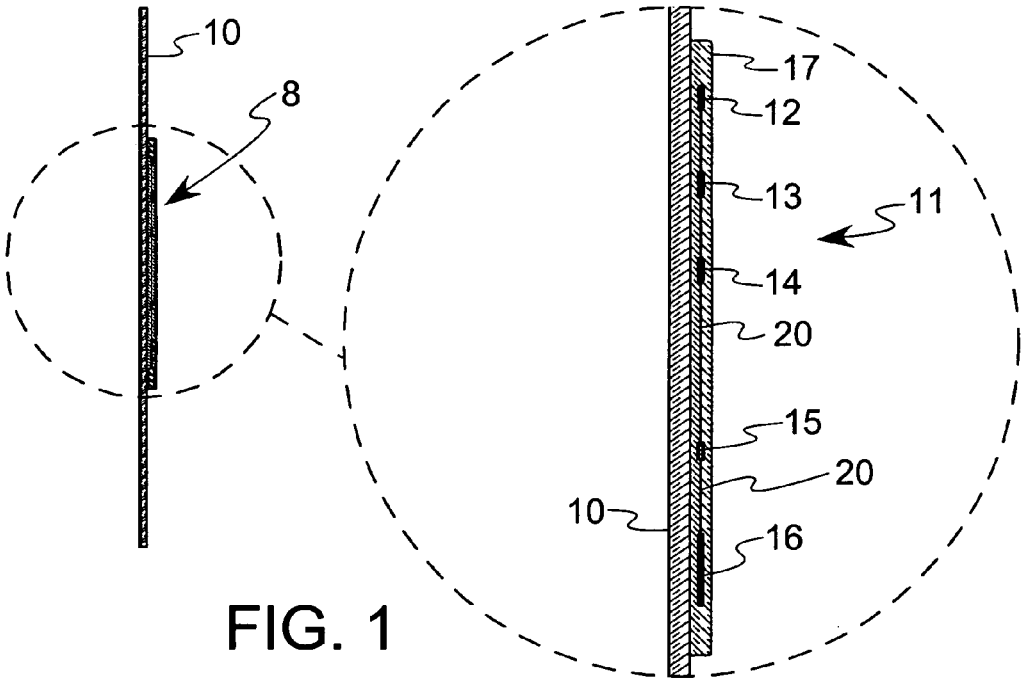
FIG. 1 is a side view illustrating the preferred embodiment of the present invention.

In describing the preferred embodiment of the invention, which is illustrated in the drawings, specific terminology will be resorted to for the sake of clarity. However, it is not intended that the invention be limited to the specific term so selected, and it is to be understood that each specific term includes all technical equivalents which operate in a similar manner to accomplish a similar purpose. For example, the word connected or term similar thereto are often used. They are not limited to direct connection but include connection through other elements where such connection is recognized as being equivalent by those skilled in the art. In addition, circuits are illustrated which are of a type which perform well-known operations on electronic signals. Those skilled in the art will recognize that there are many, and in the future may be additional, alternative circuits which are recognized as equivalent because they provide the same operations on the signals.

DETAILED DESCRIPTION OF THE INVENTION

The preferred embodiment of the present invention is shown in FIG. 1, in which a display device 8 is mounted to a substrate, such as the surface of the glass window 10, which is oriented vertically. The window 10 can be, for example, a window in a home, place of business or automobile. Virtually any surface can function as the substrate to which the present invention is attached, and the substrate need not be vertically oriented, although this is preferred in order to reduce any non-shear forces that tend to remove the display device. The substrates include, but are not limited to, walls, mirrors, windows, doors, appliances, skylights and sunroofs.

The display device 8 includes a static cling mounting film, such as the polymer film 17, that is mounted to the substrate by static attraction between the film 17 and the glass window 10. In the FIG. 1 embodiment there is no adhesive interposed between the film 17 and the window 10. Attached to the mounting film is an illumination assembly 11 that preferably includes a light source, such as the light emitting diodes (LED) 12, 13 and 14, and a switch, such as the manually-actuated switch 15. In a most preferred embodiment, the illumination assembly 11 includes a power supply, such as the battery 16, although the power supply can be located outside of the illumination assembly as will be described below.

The preferred illumination assembly 11 is an electrical circuit that includes the battery 16, the LEDs 12, 13 and 14, the switch 15 and the electrical conductors 20 electrically connecting these elements together. In FIG. 1, the conductors 20 are formed of insulated copper wires but can be formed of any electrically conducting structure, such as circuit paths (traces) on circuit boards. The electrical circuit can be mounted on a flexible or inflexible panel that is contained within a housing. For example, it is contemplated that the LEDs, the battery and the switch are all enveloped within a transparent acrylic, polycarbonate or other material. In a particularly preferred embodiment of the present invention shown in FIG. 1, the illumination assembly 11 is attached to the polymer film 17 by enveloping the assembly 11 within the polymer film 17. The illumination assembly 11 is thereby surrounded by the polymer film 17, which encloses and encases the illumination assembly 11 therein. Thus, the polymer film 17 serves as the mounting film and as the housing for the illumination assembly 11.

The illumination assembly can, alternatively, be a separate body that attaches to the mounting film in any conventionally known way, including welding, adhesives, magnets, fasteners, static attraction, or any suitable attaching means. In one such embodiment shown in FIG. 2, the LED 34, the battery 35, the switch 36 and the conductors 38 of the illumination assembly 31 are all encased within a housing, 32 that is attached to a mounting film 39 so that there is no apparent distinction between the housing 32 and the mounting film 39. In the embodiment shown in FIG. 2, the illumination assembly 31 is attached to the film 39 by an adhesive interposed between the film 39 and the housing 32. The film 39 is statically mounted to the substrate 30.

Figure 3:
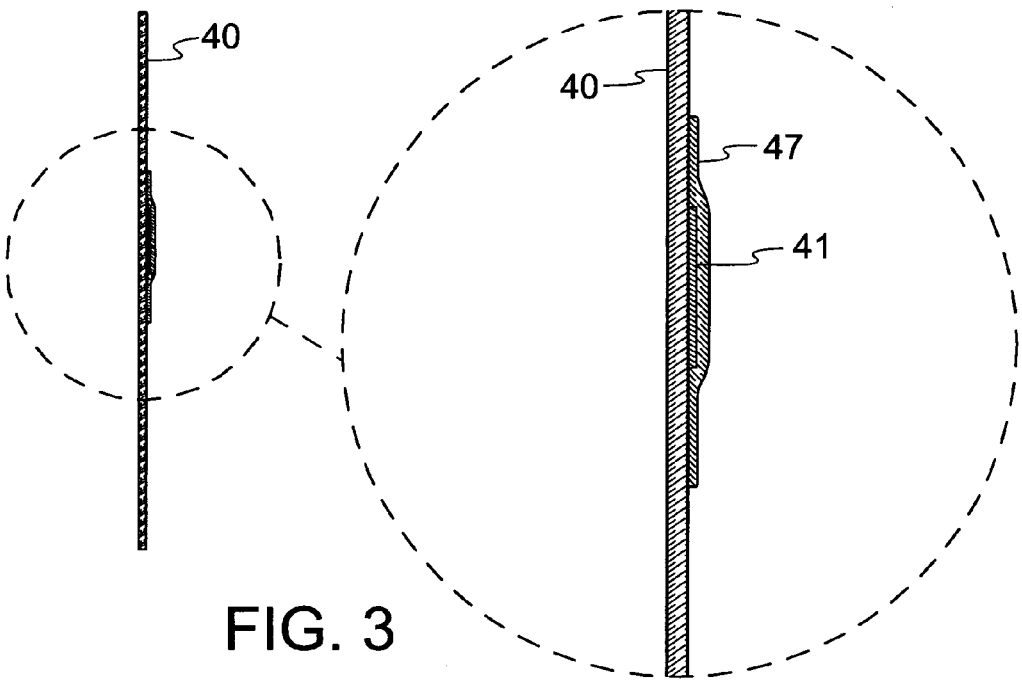
FIG. 3 is a side view illustrating an alternative embodiment of the present invention.

In still another alternative embodiment shown in FIG. 3, the illumination assembly 41 is also mounted to the mounting film 47 by an adhesive, but the assembly 41 is interposed between the substrate 40 and the film 47.

Figure 2:
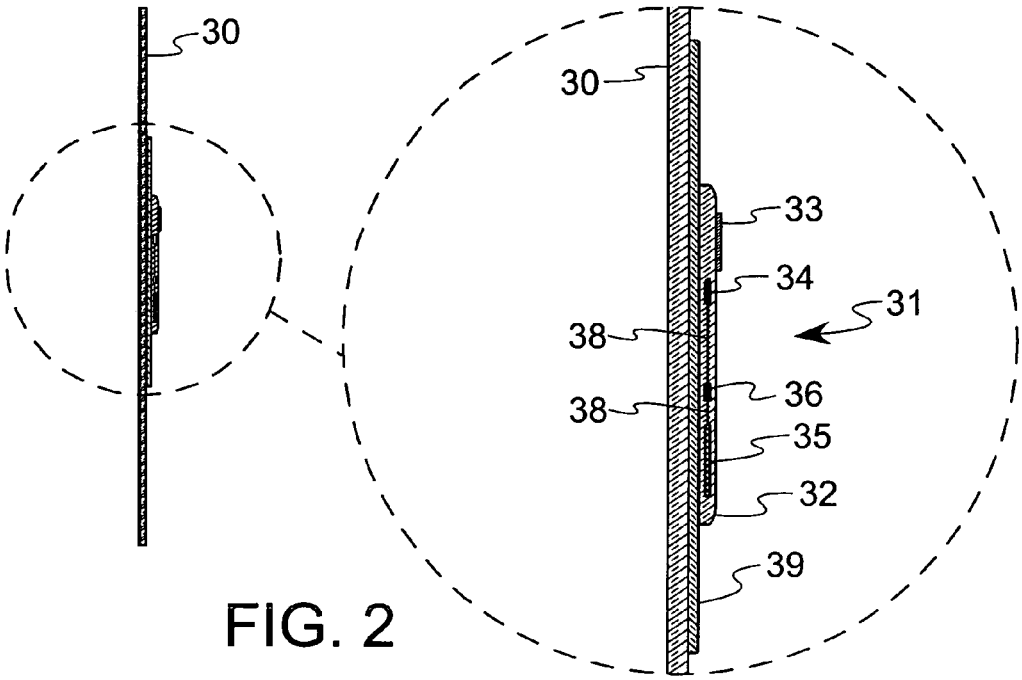
FIG. 2 is a side view illustrating an alternative embodiment of the present invention.

It is possible for there to be only one light source in the display device of the present invention as shown in FIG. 2, but there is no upper limit to the number of light sources that can be used. There can be from one to a virtually unlimited number of such illumination sources. It is possible for the display device to contain hundreds of LEDs that form a matrix that can be selectively illuminated to form recognizable words, images or other patterns.

The light source can be any light-emitting device such as light-emitting diodes (LEDs) of all types, light-emitting polymers, semiconductor dies that produce light in response to the flow of electrical current through them, electroluminescent strips, liquid crystals, organic and other such illuminating means, including electroluminescence lighting means described in U.S. Pat. No. 4,775,964, which is incorporated herein by reference. This is but one example of an electroluminescence-based light-emitting layer in which an external power source is employed to generate light using either inorganic or organic light emitting materials. The output range of light of the LEDs or any other light source can be controlled from white to any color in the spectrum, and the brightness can also be controlled, if desired. It is contemplated that any source of visible light, or light that is invisible but creates effects that can be sensed by humans, could be used as the light source.

The switch 15 of FIG. 1 controls the flow of electrical current through the circuit from the battery 16 to the LEDs 12, 13 and 14. The switch 15 can be a manually-actuated device, such as finger-depressible mechanical switch, or it can be any other type of manually actuatable switch, such as pressure or temperature-sensitive switches as are known in the art. The manually-actuated switch requires a person to manually actuate it, such as by pressing a button or flipping a lever, to allow current to pass through the circuit to the light source or sources.

Alternatively, the switch 15 can be an automatically-actuated device that is triggered automatically, such as by detecting motion, a change in available light, a change in temperature, or by being programmed to actuate at a predetermined time of day or a predetermined date. For example, an automatically-actuated switch may be actuated in response to movement by a person or a thing (such as a car) in close proximity to the sign. As another example, a display device used as a store sign can light up aligned LEDs, that spell the word OPEN at 8:00 AM indicating that a retail establishment is ready to receive customers. The same sign may then be switched automatically to cease lighting up the word OPEN and subsequently illuminate the word CLOSED at 5:00 PM to indicate that the establishment is no longer receiving customers. A temperature activated switch maybe utilized to measure the temperature outside and thus initiate a sign to light up an advertisement for air conditioners or space heaters. A switch which responds to the brightness of daylight may be used to actuate messages that would attract patrons in the evening hours, such as for bars or dance clubs. Such a switch would keep the sign off during daylight hours. Switches of the types described are currently available on the market and include photoelectric transducers, timers and motion detectors.

The battery 16 shown in FIG. 1 is but one example of an electrical power supply that will energize the LEDs of the illuminating assembly 11. There are various types of batteries currently available which can be used to achieve the desired result. These include, but are not limited to, rechargeable and non-rechargeable batteries, button-type batteries and chemical batteries that are commonly referred to as AAA and 9 volt.

It is also contemplated that power supplies other than batteries can be employed to supply power to the display device. These include common residential and commercial electrical systems, such as 110 volt alternating current power (to be used for large or permanent signs). Connection to such power supplies can be accomplished by plugging the device into a wall outlet or by wiring the display device directly to the electrical system. The power line for attachment to the outlet can include a power cord and a transformer to transform the alternating current to direct current or an adapter to reduce the voltage of the power supply. Alternatively, the power supply may be an array of photovoltaic transducer cells, such as those used in portable electronic devices (for example, pocket calculators). Such a power supply can also be used in conjunction with rechargeable batteries that can function as the power supply when there is insufficient light and are charged when there is sufficient light.

The surface upon which the display unit will be attached can include any surfaces to which a planar, flexible film can attach. This includes any smooth surface such as glass, plastic, paper, wood, or metal. The surface may also include light matte or textured surfaces, such as those found on kitchen appliances or painted or wallpapered walls. Although the preferred mounting film is a static cling film, it is contemplated that an adhesive, and especially a pressure-sensitive adhesive, can be used instead of, or as a supplement to, the electrostatic attraction between the mounting film and the substrate that mounts the preferred display device to the substrate.

It is preferred that at least one indicium, and possibly many indicia, be on the mounting film, the illumination assembly, or any other visible part of the display device for display and possibly for cooperation with the light sources. The indicia can be printed on the mounting film (using conventional printing techniques or hand-written indicia), attached in the form of decals that have an adhesive layer, or by statically attached decals. The indicia can be permanently or removably attached to the polymer film. Additionally, the indicia can be translucent or opaque. Examples of indicia include alphanumeric characters, photographs, symbols, trademarks, drawings and any other extremely thin visible matter. The indicia can have variations in opacity or translucency to block some of the light from the light sources in the display device and permit some of the light to pass through.

The indicia on the film can be on one major surface of the display device, the opposite major surface, both and/or between layers. The position of the indicia depends, in part, upon the transparency or translucency of the mounting film and the substrate upon which the device is mounted. For example, in the embodiment of FIG. 4, there is a display device 64 with an indicium 60 that has the appearance of a Christmas tree. The film 62 can be opaque or transparent/translucent, depending upon the desired appearance of the display device. The indicium 60 is preferably opaque if the mounting film is not, in order to hide the illumination assembly that is mounted behind the major surface upon which the indicium 60 is printed. If the indicium 60 is opaque, then in the locations behind which simulated light bulbs 65, 66 and 67 are mounted, such as where there are LEDs as described above, there can be either transparent or translucent indicia regions, or there can be the absence of any ink or other material. The FIG. 4 structure permits the light of the light source to pass through the mounting film and be displayed in the form of a lighted Christmas tree to observers.

Instead of printing the indicia on the mounting film, the indicia may be printed on one or more separate films that can be attached to the mounting film. For example, a static cling decorative film 33 is decorated with various indicia, cut out by hand or otherwise, and the cutout "decal" statically and removably attached to the mounting film 39 as shown in FIG. 2. Alternatively, these cutout decals can be statically and removably attached to the illumination assembly or to another intermediary film. The cutouts can also be adhesively attached to the illumination assembly, the mounting film or an intermediary film. The cutouts may consist of any symbols, lettering, pictures, numbers, photographs, and may come in a color scheme desired or designed by the owner of the display device. The cutout decals may be made of the same material as the mounting film or another, compatible film. For example, the display device could be sold in a kit that includes transparent mounting film, an illumination assembly and instructions on how to attach the illumination assembly to the mounting film after using marking pens or other instruments to create indicia on the mounting film. Alternatively, decals can be packaged with the mounting film and illumination assembly.

Figure 5:
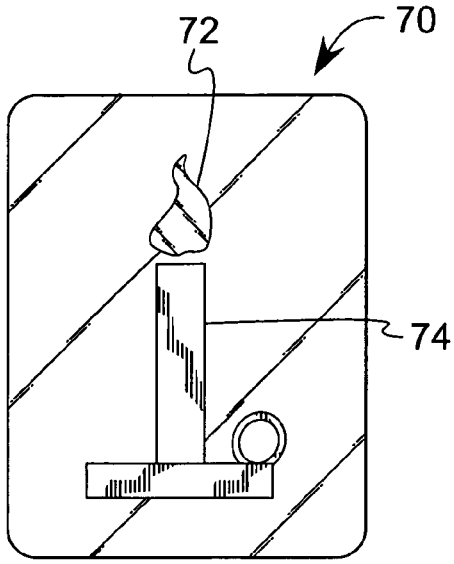
FIG. 5 is a front view illustrating an alternative embodiment of the present invention.

In an alternative embodiment shown in FIG. 5, a display device 70 has indicia 72 and 74 in the form of a candle imprinted upon the major surface of the display device that is seated against the substrate (not shown). The mounting film of the display device 70 is transparent, and the elements of the illumination assembly, including an LED, a battery, a switch and conductive wires, are mounted behind the indicia 72 and 74. All elements of the illumination assembly, except the LED, are mounted behind the opaque indicium 74, and the LED is behind the translucent yellow indicium 72. Upon actuating the switch, the LED lights up the indicium 72 thereby giving the display device 70 the appearance of a window candle. Such a display device can be mounted in each window of a home thereby giving a pleasing appearance while eliminating the safety concerns that arise with conventional candle lamps. The display device 70 can, for example, be made of an LED that is one to three millimeters in diameter, a button-type battery that is less than three millimeter in thickness, and a static film with a pressure-sensitive switch incorporated thereinto. Such a display device is less than four millimeters thick at its thickest point and less than one millimeter thick throughout most of its area.

In order for a static cling mounting film to function as desired in the present invention, it should meet certain requirements. The film should possess the ability to cling statically to a substrate, preferably be printable, uniformly clear or opaque, thermal and ultraviolet stable, and flexible. The physical and chemical properties of the film can be manipulated by changes in the composition of the material or by preparing multi-layer films, as is known in the art. The polymer for the cling layer can be selected to enhance and maximize the desired cling properties (initially and after aging), and the polymer for the print layer can be selected to provide superior ability to receive an ink imprint. The composition, preparation, and modification of these films to meet these requirements are known to persons possessing ordinary knowledge in the art.

The mounting film's electrostatic attraction to the substrate supports the elements of the illumination assembly, thereby attaching the illumination assembly to the smooth substrate surface. In all the examples described, the mounting film is a means to statically attach the display device to the smooth supporting surface of the substrate. The attachment is achieved without the use of glues or adhesives, although in an alternative embodiment it is contemplated that adhesives can be used either as the primary attachment means or to supplement the electrostatic attraction of the polymer film to the substrate. The flexible mounting film clings to the surface by electrostatic attraction, as a result of a vacuum that is formed when the flexible film is applied to a smooth surface, or a combination of the two. The film can be removed easily from the substrate and reapplied to the same or a different substrate a number of times.

Figure 4:
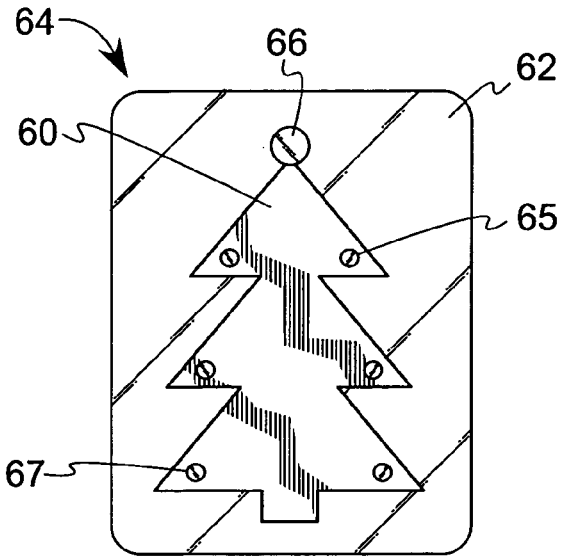
FIG. 4 is a front view illustrating an alternative embodiment of the present invention.

The FIG. 4 embodiment preferably includes the mounting film printed with a green colored Christmas tree upon which is placed red ornaments. The Christmas tree is printed in the center of a transparent film. The LEDs are arranged to correspond to the respective position of ornaments on the film. The LEDs are connected together and to the power source and switch.

Alternatively, the film surrounding the indicium may be colored and may have the desired opaqueness. It will become apparent to persons having ordinary skill in the art to modify the translucency or opacity of the mounting film, the indicia, the illumination assembly or any components thereof to affect the appearance of the display device. Additionally, if the substrate to which the display device is mounted is transparent or translucent, the indicia can be viewed from either side of the display device if the display device is transparent or translucent. Alternatively, if the substrate to which the display device is mounted is opaque, then the indicia will have to be printed or otherwise disposed on a portion of the display device that is visible from the side of the substrate to which the display device is mounted. For example, a display device is contemplated that is mounted to a mirror, and the indicia are mounted to the major surface of the display device facing away from the mirror. This would not be necessary if parts of the mounting film are transparent or translucent, however.

The arrangement of LEDs in the illumination assembly can follow any desired pattern or no particular pattern. The LEDs may be placed in a geometric design, or they can be positioned to correspond to positions in the indicia. Thus, desired portions of the indicia can be illuminated, or the indicia can be illuminated in a random manner.

Figure 6:
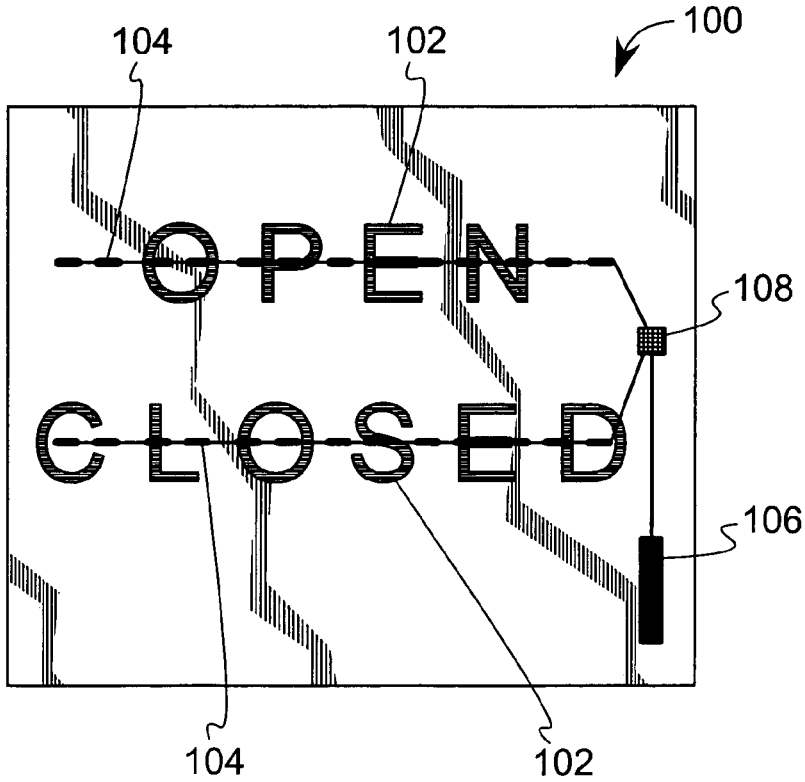
FIG. 6 is a front view illustrating an alternative embodiment of the present invention.

A display device 100 in the form of an "open/closed" sign is shown in FIG. 6. The lettering indicia 102 in the sign are illuminated by LEDs 104 connected to a battery 106. Each of the words formed by the indicia has its own line of LEDs linked to the battery 106. These lines are separately wired to a switch 108 and the switch 108 is wired to the battery 106. The switch 108 has three positions: no LEDs illuminated, the top line of LEDs illuminated and the bottom line of LEDs illuminated. Thus, by depressing the switch 108, the sign functions to illuminate either the OPEN or the CLOSED indicia, or neither.

The ability of the film to cling to the surface of a smooth substrate is an important attribute of the material. The film must adhere to the substrate for a desired period of time and must not be easily removed (e.g. by accident). The peel force requirements for a given use differ depending on the desired effect sought in the application. The peel force is defined as the amount of force necessary to remove the cling film after the film has been applied to a substrate such as glass. The 180 degree peel force can be measured by utilizing a peel test (as described in U.S. Pat. No. 6,171,681 Mascarenhas, et al., which is incorporated herein by reference), which is a modification of PSTC Test Methods for Pressure Sensitive Tapes (Eighth Edition) PSTC-1, appendages A and B (Parts 2.5 and 2.6). The smooth surfaces generally are characterized as having a surface smoothness of less than about 30 Ra. The surface smoothness is measured using a profilometer (as described in the Mascarenhas, et al. patent above).

The adhesion, flexibility, clarity and print capability of the film can be manipulated by changes in the composition of the material or by preparing multiple layer films. That is, the polymer for the cling layer can be selected to enhance and maximize the desired cling properties (initially and after aging), and the polymer for the print layer can be selected to provide superior imprint ability. The composition, preparation, and modification of these films to meet these requirements are known to persons possessing knowledge in the art.

While certain preferred embodiments of the present invention have been disclosed in detail, it is to be understood that various modifications may be adopted without departing from the spirit of the invention or scope of the following claims.

The invention claimed is:

1. A display device comprising:

(a) an electrical power supply;

(b) an illumination assembly including a light source and a switch electrically interposed between the light source and the electrical power supply; and (c) a translucent mounting film for mounting the illumination assembly and the mounting film to a smooth substrate, said mounting film having a first major surface and a second, opposite major surface, wherein the illumination assembly and the power supply are mounted to one of said major surfaces and are disposed on only one side of the mounting film, but are not sandwiched between the mounting film and another film, and the mounting film is a static cling film for mounting to the substrate with static attraction.

2. The display device in accordance claim 1, wherein the mounting film has at least one indicium on at least one of the major surfaces thereof.

3. The display device in accordance with claim 2, wherein the illumination assembly is attached to the first major surface of the mounting film and said at least one indicium is on the second, opposite major surface of the mounting film.

4. The display device in accordance with claim 2, wherein the illumination assembly is attached to the first major surface of the mounting film and said at least one indicium is also on the first major surface of the mounting film, wherein said at least one indicium is sandwiched between the illumination assembly and the mounting file.

5. The display device in accordance with claim 4, wherein the mounting film is a substantially planar sheet with peripheral edges that extend beyond the illumination assembly.

6. The display device in accordance with claim 2, wherein the mounting film is attached to the illumination assembly by static attraction.

7. The display device in accordance with claim 2, further comprising an adhesive interposed between the mounting film and the illumination assembly for attaching the illumination assembly to the mounting film.

8. The display device in accordance with claim 2, wherein said at least one indicium is selected from the group of alphanumeric characters, photographs, symbols and trademarks.

9. The display device in accordance with claim 2, wherein said at least one indicium is printed on at least one decorative film attached to said mounting film.

10. The display device in accordance with claim 9, wherein said at least one decorative film is attached to said mounting film by an adhesive layer interposed between the mounting film and the decorative film.

11. The display device in accordance with claim 2, wherein said at least one indicium is printed onto the mounting film.

12. The display device in accordance with claim 11, wherein the mounting film is transparent.

13. The display device in accordance with claim 11, wherein the mounting film is colored.

14. The display device in accordance with claim 11, wherein said at least one indicium is opaque.

15. The display device in accordance with claim 2, wherein the power supply is a battery.

16. The display device in accordance with claim 15, wherein the battery is mounted to the mounting film.

17. The display device in accordance with claim 2, where in the power supply is a photoelectric transducer.

18. The display device in accordance with claim 2, where in the power supply is alternating current.

19. The display device in accordance with claim 2, where in the switch is manually actuatable.

20. The display device in accordance with claim 2, where in the switch is automatically actuatable.

21. The display device in accordance with claim 20, where in the switch is photo sensing.

22. The display device in accordance with claim 20, wherein the switch is motion sensing.

23. The display device in accordance with claim 20, where in the switch is chronologically programmable.

24. The display device in accordance with claim 2, wherein the light source further comprises at least one LED.

25. The display device in accordance with claim 24, wherein said at least one LED further comprises a plurality of LEDs.

26. The display device in accordance with claim 25, wherein the LEDs are positioned to correspond to at least one indicium on said mounting assembly.

27. A display device comprising:

(a) an illumination assembly having an electrical circuit including a battery, a light source and a switch electrically interposed between the light source and the battery; and (b) a translucent mounting film attached to the illumination assembly, the mounting film having a first major surface and a second, opposite major surface with at least one indicium, wherein the mounting film is a static cling film for mounting the illumination assembly and mounting film to a substrate with static attraction, and wherein the illumination assembly is disposed on only one side of the mounting film, but is not sandwiched between the mounting film and another film.

28. The display device in accordance with claim 27, wherein the light source further comprises at least one LED.

29. The display device in accordance with claim 27, where in the switch is manually actuatable.

30. The display device in accordance with claim 27, wherein the electrical circuit including the battery, the light source and the switch is enclosed within a housing that is attached to the mounting film.

31. A display device in combination with a substrate, the combination comprising:

(a) an illumination assembly having an electrical circuit including a battery, a light source and a switch electrically interposed between the light source and the battery; and (b) a translucent mounting film attached to the illumination assembly, the mounting film having a first major surface and a second, opposite major surface with at least one indicium, wherein the mounting film is a static cling film mounting the illumination assembly and mounting film to the substrate with static attraction and wherein the illumination assembly is disposed on only one side of the mounting film, but is not sandwiched between the mounting film and another film.

32. The display device in accordance with claim 31, wherein the light source further comprises at least one LED.

33. The display device in accordance with claim 31, where in the switch is manually actuatable.

34. The display device in accordance with claim 31, wherein the electrical circuit including the battery, the light source and the switch is enclosed within a housing that is attached to the mounting film.

35. The display device in accordance with claim 31, wherein the substrate is a window.

36. The display device in accordance with claim 35, wherein the window is vertically oriented.

37. The display device in accordance with claim 35, wherein the window is angled relative to horizontal.

38. The display device in accordance with claim 31, wherein the substrate is a wall.

39. The display device in accordance with claim 31, wherein the substrate is a mirror.

40. A method for displaying at least one indicium, comprising:

(a) constructing an illumination assembly having an electrical circuit including a battery, a light source and a switch electrically interposed between the light source and the battery;

(b) attaching a translucent static cling mounting film to the illumination assemble, the mounting film having a first major surface and a second, opposite major surface, thereby mounting the illumination assembly on only one side of the mounting film, but not sandwiching the illumination assembly between the mounting film and another film;

(c) placing at least one indicium on one of said major surfaces of the mounting film;

(d) seating one of said major surfaces of the mounting film against a substrate;

(e) adhering the mounting film to the substrate with static attraction between the mounting film and the substrate; and (f) manually actuating the switch.

41. A display device in combination with a smooth, transparent substrate, the combination comprising:

(a) and illumination assembly having an electrical circuit including a battery, a light source and switch electrically interposed between the light source and the battery; and (b) a translucent, static cling mounting film attached to the illumination assembly, wherein the illumination assembly is disposed only one side of the mounting film and is not sandwiched between the mounting film and another film, and the illumination assembly and the mounting film are mounted to the substrate with static attraction, the mounting film having a first major surface and a second, opposite major surface, one of said major surfaces having at least one indicium thereon that is visible when light passes through the translucent mounting film and the substrate.

* * * * *

UNITED STATES PATENT AND TRADEMARK OFFICE

CERTIFICATE OF CORRECTION

PATENT NO. : 7,065,910 B2
APPLICATION NO. : 10/718078
DATED : June 27, 2006
INVENTOR(S) : Michael A. Woodruff It is certified that error appears in the above-identified patent and that said Letters Patent is hereby corrected as shown below:

Col. 11 Claim 40, line 8, add --assembly--, delete "assemble"

Col. 11 Claim 41, line 3, add --an--, delete "and"

Signed and Sealed this

Twelfth Day of December, 2006

JON W. DUDAS
*Director of the United States Patent and Trademark Office*